United States Patent [19]

Rittel et al.

[11] Patent Number: 4,979,443

[45] Date of Patent: Dec. 25, 1990

[54] LINER FOR A WARHEAD WITH PROTRUDING CENTRAL PORTION

[75] Inventors: Rolf Rittel, Velbert; Torsten Niemeyer, Hilden; Peter Tripptrap, Langenfeld; Jürgen Böcker, Oberhausen, all of Fed. Rep. of Germany

[73] Assignee: Rheinmetall GmbH, Düsseldorf, Fed. Rep. of Germany

[21] Appl. No.: 332,277

[22] PCT Filed: Mar. 5, 1988

[86] PCT No.: PCT/EP88/00171

§ 371 Date: Mar. 3, 1989

§ 102(e) Date: Mar. 3, 1989

[87] PCT Pub. No.: WO89/00274

PCT Pub. Date: Jan. 12, 1989

[30] Foreign Application Priority Data

Jul. 3, 1987 [DE] Fed. Rep. of Germany ..... 3722024

[51] Int. Cl.[5] ..... F42B 1/02

[52] U.S. Cl. ..... 102/307; 102/310; 102/476; 102/501

[58] Field of Search ..... 102/306, 307, 310, 476, 102/501

[56] References Cited

U.S. PATENT DOCUMENTS

| | | | |
|---|---|---|---|
| 2,513,233 | 6/1950 | Byers | 102/24 |
| 3,077,834 | 2/1963 | Caldwell | 102/24 |
| 3,478,685 | 11/1969 | Thomanek et al. | 102/24 |
| 3,732,816 | 5/1973 | Muller | 102/24 |
| 4,359,943 | 11/1982 | Majerus | 102/309 |
| 4,436,033 | 3/1984 | Precoul | 102/307 |
| 4,474,113 | 10/1984 | Kyro et al. | 102/306 |
| 4,537,132 | 8/1985 | Sabranski et al. | 102/307 |
| 4,672,896 | 6/1987 | Precoul et al. | 102/309 |
| 4,702,171 | 10/1987 | Tal et al. | 102/476 |
| 4,854,240 | 8/1989 | Hirsch et al. | 102/476 |
| 4,896,609 | 1/1990 | Betts et al. | 102/309 |

*Primary Examiner*—Peter A. Nelson

*Attorney, Agent, or Firm*—Spencer & Frank

[57] ABSTRACT

An improved liner for a warhead having a shaped explosive charge for the production of a projectile by explosive reshaping of the liner includes a liner body having a central region which has a radius of curvature which is smaller than that of a surrounding liner portion. The central region of the liner is indented relative to the surrounding liner portion along a central axis of the liner body toward the side of the liner adjacent the shaped explosive charge. Upon explosive reshaping of the liner, a projectile having an ogival shape is produced.

11 Claims, 2 Drawing Sheets

LINER FOR A WARHEAD WITH PROTRUDING CENTRAL PORTION

BACKGROUND OF THE INVENTION

The invention relates to a liner for a warhead of the type having a liner for the production of a projectile by explosive reshaping of the liner.

U.S. Pat. No. 4,356,770 discloses a warhead including a liner in the form of a spherical segment. Explosive reshaping forms from this spherical segment an essentially rod-shaped projectile which, however, due to its aerodynamically unfavorable shape, exhibits unstable flight behavior, a high loss in velocity and consequently an unsatisfactory final ballistic performance. The great drop in velocity is caused essentially by the hemispherical shape of the projectile tip.

The unpublished German patent application No.bP 3,529,405.1 already discloses a liner for a warhead in which modification of the center of the liner permits the realization of an ogival projectile tip. However, difficulties have resulted in practice if the liner is used with a very violent explosive because the use of the above-mentioned application results in a shaped charge projectile tip which may burst open if a very violent explosive is employed.

German Patent No. 1,195,641 discloses liners for the production of projectiles by explosive reshaping in which the progressive weakening of the wall thickness of the liner produces slender projectiles which travel at a high velocity. The primary drawback of these projectiles is that the projectile tip, primarily if a violent explosive is employed, is relatively blunt because the wall thickness in the center of the liner must not fall below a given value which is a function of the explosive.

SUMMARY OF THE INVENTION

It is an object of the present invention to provide a liner for a warhead which permits the production of a projectile by explosive reshaping, with the projectile presenting a better final ballistic performance even in conjunction with violent explosives. In particular, a pointed projectile tip is to be produced so that an increase in target velocity results.

This is accomplished by the provision of a liner with a greater identation disposed on a central region of the liner on the side of the explosive.

BRIEF DESCRIPTION OF THE DRAWINGS

The invention will now be described in greater detail with reference to embodiments thereof and with the aid of drawing figures.

It is shown in.

DETAILED DESCRIPTION OF THE PREFERRED EMBODIMENT

Figure 1:
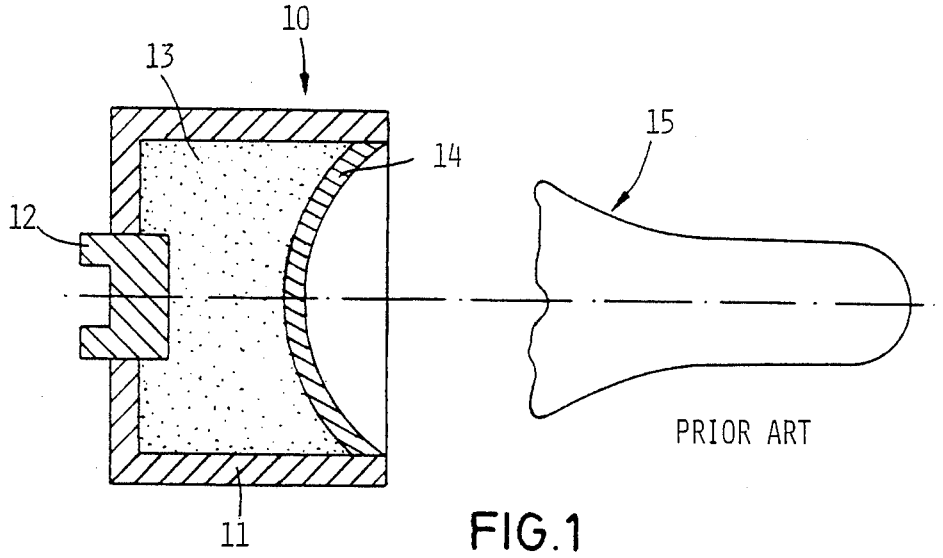
FIG. 1, a longitudinal sectional view of a conventional warhead equipped with a liner and a projectile produced from the liner by explosive reshaping.

FIG. 1 shows a warhead 10 having an essentially hollow cylindrical configuration in whose housing 11 an explosive charge 13 is disposed so as to be activated by a fuze 12. Explosive charge 13 is delimited on one side by a cap-shaped liner 14 from which a projectile can be formed by explosive reshaping.

In the conventional warhead 10, liner 14 has the shape of a spherical segment. After ignition of explosive charge 13, explosive reshaping produces from such an insert a projectile as shown schematically at 15 in FIG. 1. Such projectiles exhibit a great drop in velocity during flight which is th result of the aerodynamically unfavorable configuration of the tip of projectile 15. As shown in FIG. 1, the projectile 15 produced from liner 14 has a tip in the shape of a hemisphere.

Figure 2:
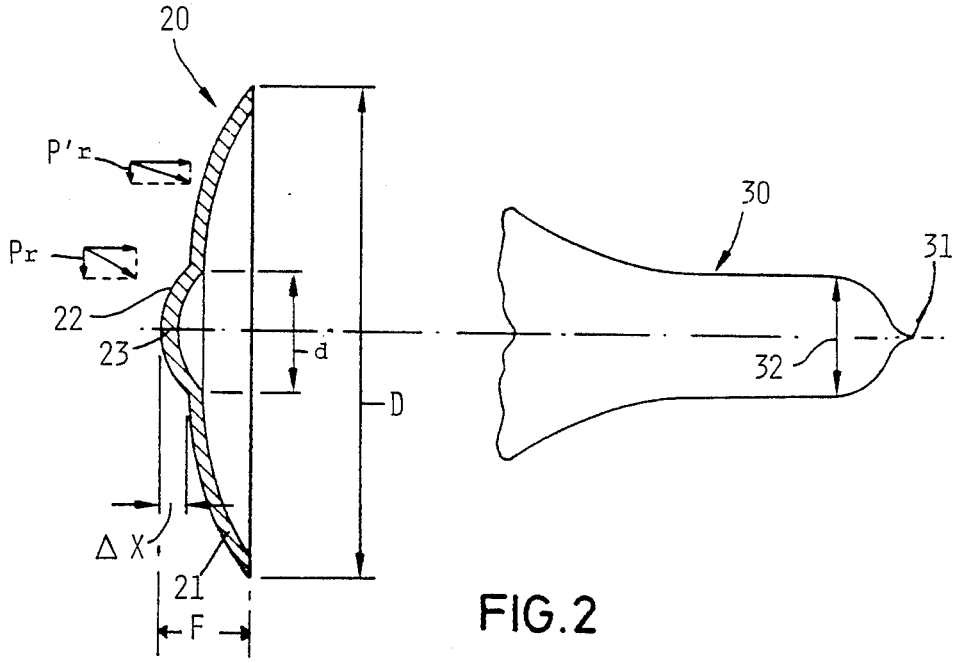
FIG. 2, a spherical segment shaped liner and a projectile produced from the liner.

FIG. 2 shows a liner 20 having an outer diameter D and a height F along a central axis 23 of the liner 20 which, except for a central region 22, essentially corresponds to liner 14 (FIG. 1). The central region 22 has a diameter d centered about 20, and the liner has a greater convex curvature in a direction toward the side of the liner 20 adjacent the explosive 13 (FIG. 1) than the curvature of a surrounding liner portion 21 outside the region 22. It has been found that this change in the liner geometry produces a projectile 30 by explosive reshaping of the liner 20 which has an ogival projectile tip 31 with a simultaneously reduced tip diameter indicated by a double-headed arrow 32. The geometric change in the central region 22 of the liner 20 may have any desired shape (linear, square, S-shaped, etc.) such that the radial pressure components Pr at the edge of region 22, but still within the region 22, are greater than the radial pressure components P'r outside the central region 22 which are in the immediate vicinity of the central region 20.

The central region 22 has a height $\Delta x$ from the adacent part of the surrounding liner portion 21. The height $\Delta x$ and the diameter d of the region 22 required to produce the geometric change desired, are a function of the explosive employed and of the liner material, and must be experimentally determined in each case.

For example, if Octol 70/30 is employed as the explosive and iron as the liner material, the maximum diameter d of the region 22 is about 10 to 25% of a diameter D of the liner 20 and the height $\Delta x$ of the curved central region 22 (i.e., the height of the indentation) in the central region must be less than 15% of the height of the adjacent protion of the surrounding liner portion of the liner 20.

Figure 3:
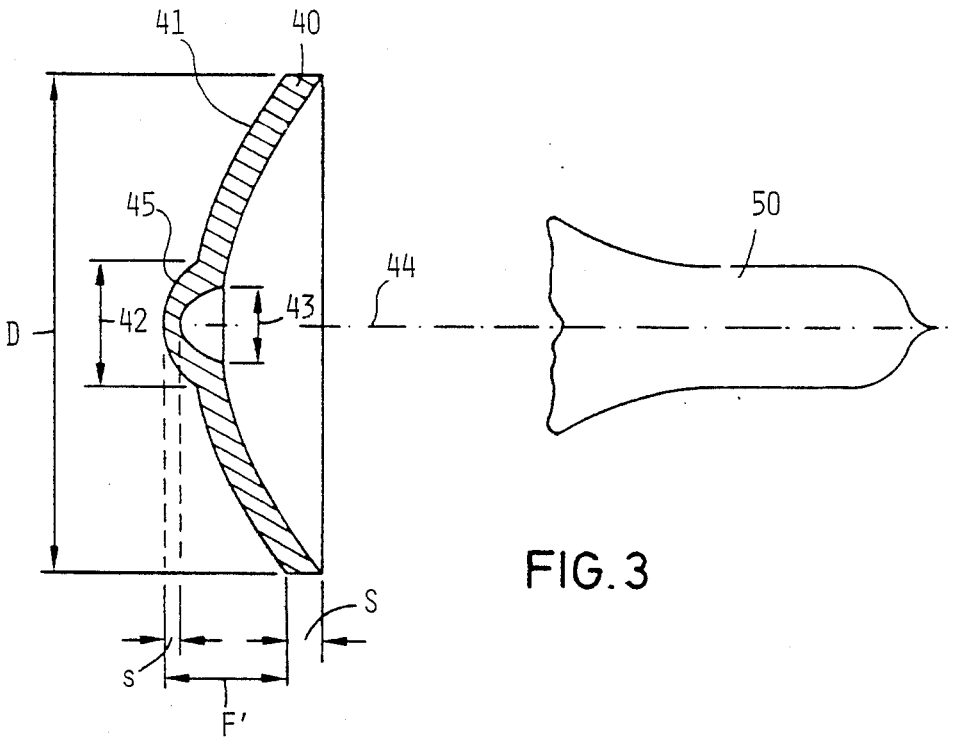
FIG. 3, a further embodiment of a liner according to the invention together with the projectile produced from the liner by explosive reshaping.

To further optimize the ogival shape of a projectile 50, as shown in FIG. 3, a wall thickness s of a liner 40 within a central region 45 of the liner 30 may additionally be selected to be smaller, at least in a partial region, than a wall thickness S of the surrounding liner portion 41 outside the central region 45. A liner height F of the liner 40 is shown in FIG. 3 having a central axis 44. The central region 45 has an inner maximum diameter 43 and an outer maximum diameter 42.

In this case, similar to that described with reference the projectile to FIG. 2 50 is produced by explosive reshaping of the liner 40. The region central 45 around the central axis 44 of the liner 40 corresponds to the region 22 of FIG. 2. Within the central region 45, in a partial region delimited radially by the radius of the inner maximum diameter 43, the geometry of the liner 40 is changed in such a manner that the corresponding thickness s becomes smaller than the thickness S of the liner 40 outside the region delimited radially by the radius of the outer maximum diameter 42. However, the remaining wall thickness of the liner 40 delimited radially by the radius of the inner maximum diameter must be selected so that the liner 40 does not burst if the explosive is particularly violent.

Figure 4:
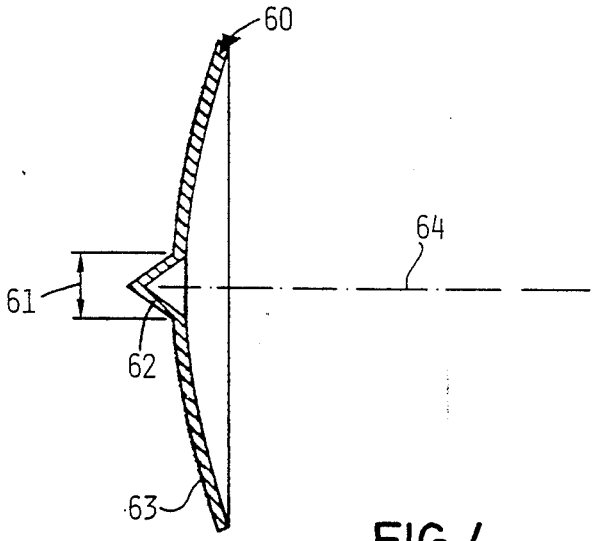
FIG. 4, a further liner according to the invention and its conical central region.

As shown in FIG. 4, a liner 60 may also be given a linear (i.e. conical) shape in a central region 62 around central axis 64 of the liner 60. The central region 62 of the liner 60 has a maximum outer diameter 61.

We claim:

1. Liner for a warhead having a shaped explosive charge for the production of a projectile having an ogival tip by explosive reshaping of the liner, comprising: a liner body having a central axis of symmetry, one side of said liner body facing the shaped explosive charge, said liner body including a central region and a surrounding liner portion which is disposed generally coaxially around said central region of said liner body, said surrounding liner portion being generally convex on said one side of said liner body which is adjacent the shaped explosive charge, said central region of said liner body being indented relative to said surrounding liner portion and generally convex on said one side of said liner body facing the shaped explosive charge, and said one side of said liner body in said central region, as viewed in a direction parallel to said central axis of said central region, protrudes a predetermined distance from the convex said one side of said liner body in said surrounding liner portion in the direction toward the shaped explosive charge.

2. Liner according to claim 1, wherein said surrounding liner portion has a first wall thickness and said central region has a second wall thickness which is substantially equal to said first wall thickness of said surrounding liner portion.

3. Liner according to claim 1, wherein said surrounding liner portion has a first wall thickness and said central region of said liner body has at least a portion which has a second wall thickness which is less than said first wall thickness of said surrounding liner portion.

4. Liner according to claim 1, wherein said liner body has a predetermined outer diameter, and said central region of said liner body has a given diameter which is in a range of 10% to 35% of said predetermined outer diameter of said liner body.

5. Liner according to claim 1, wherein said liner body has a predetermined height, as viewed in a direction parallel to said central axis, between an outermost rim of said liner body and an extremity of said one side of said central region along said central axis, and said predetermined distance is equal to, at most, 15% of said predetermined height of said liner body.

6. In a warhead of the type having a casing, a shaped explosive charge provided with a liner, and a fuse for igniting the shaped explosive charge for producing a projectile by explosive reshaping of the liner, the improvement wherein said liner comprises means for forming a projectile with an ogival tip and includes a liner body having a central axis of symmetry, said liner body including a central portion and a surrounding liner portion connected to said central portion, said surrounding liner portion having an outermost rim and a innermost periphery, said surrounding liner portion being connected at its said outermost rim to the casing and having one surface adjacent the shaped explosive charge, said central portion of said liner body having an outermost periphery which joins said innermost periphery of said surrounding portion of said liner body, and having one surface adjacent the shaped explosive charge, and said surrounding liner portion having a radius of curvature centered at a first location on said central axis, wherein said radius of curvature intersects said central axis at a second location, said central portion of said liner body protrudes further in the direction toward the shaped explosive charge than said second location as viewed in a direction parallel to said central axis.

7. A liner as claimed in claim 6, wherein the wall thickness of said surrounding liner portion is substantially constant, and the wall thickness of said central portion varies such that a region of said central portion has a wall thickness which is smaller than said wall thickness of said surrounding liner portion.

8. A liner as claimed in claim 6, wherein the wall thickness of said surrounding liner portion is substantially constant, and the wall thickness of said central portion is smaller than the wall thickness of said surrounding liner portion.

9. A liner as claimed in claim 6, wherein said surrounding liner portion is symmetrical about said central axis, and said outermost rim of said surrounding liner portion extends radially from said central axis at a first predetermined radial distance, and said central region is symmetrical about said central axis, and said outermost periphery of said central region extends radially from said central axis at a second predetermined radial distance, and said second predetermined radial distance of said central region is in a range from 10% to 35% of said first predetermined radial distance.

10. A liner as claimed in claim 6, wherein said liner body has a predetermined height between said innermost periphery and said outermost rim as viewed in a direction parallel to said central axis, said innermost periphery extending relative to said outermost rim in a direction toward the shaped explosive charge, and said central portion is recessed along said central axis a specified distance in the direction toward the shaped explosive charge, said specified distance being in a range which is at most 15% of said predetermined height of said liner body.

11. A liner as claimed in claim 6, wherein said surrounding liner portion has the form of a spherical segment.

* * * * *